US006506098B1

(12) United States Patent
Ho et al.

(10) Patent No.: US 6,506,098 B1
(45) Date of Patent: Jan. 14, 2003

(54) SELF-CLEANING SLURRY ARM ON A CMP TOOL

(75) Inventors: Hu Fu Dao Ho, Taichung (TW); Ying Chih Liu, Hsih-Chu (TW); Yeong Shiang Hu, Hsinchu (TW); Simon Shu, Hsinchu (TW); Ben Liu, Hsinchu (TW); Jing Long Lin, Kaohsiung (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 10/151,134

(22) Filed: May 20, 2002

(51) Int. Cl.[7] ..... B24B 1/00

(52) U.S. Cl. ..... 451/36; 451/41; 451/60; 451/446; 156/345.12

(58) Field of Search ..... 451/41, 36, 37, 451/54, 60, 285, 446, 444; 156/345.11, 345.21; 15/415.1, 416, 104.04

(56) References Cited

U.S. PATENT DOCUMENTS 6,139,406 A * 10/2000 Kennedy et al. ..... 451/67
6,217,430 B1 4/2001 Koga et al. ..... 451/444
6,234,877 B1 * 5/2001 Koos et al. ..... 451/41
6,280,297 B1 8/2001 Tolles et al. ..... 451/41
6,283,840 B1 * 9/2001 Huey ..... 451/288
6,284,092 B1 * 9/2001 Manifredi ..... 156/345
6,290,572 B1 9/2001 Hofmann ..... 451/5
6,358,124 B1 * 3/2002 Koga et al. ..... 451/56

* cited by examiner

*Primary Examiner*—Eileen P. Morgan
(74) *Attorney, Agent, or Firm*—George O. Saile; Stephen B. Ackerman

(57) ABSTRACT

A self-cleaning apparatus for use in a chemical mechanical polishing tool. The apparatus includes a slurry-dispensing arm with a first end suspended over a polishing pad, and a second end for mounting to the chemical mechanical polishing tool. A slurry-dispensing nozzle is positioned under the first end for dispensing a polishing slurry against the polishing pad. The first end has a compound slanted top surface, a front face and adjoining side surfaces. The compound slanted top surface forms a longitudinal peak slanting from center to both sides and from the back end to the front face. The top surface of the first end has a liquid distribution manifold that is mounted distally from the front face and has a plurality of nozzles directed to spray deionized water to wash away slurry splatter from surfaces of the first end of the slurry dispensing arm during the water polishing cycle.

19 Claims, 3 Drawing Sheets

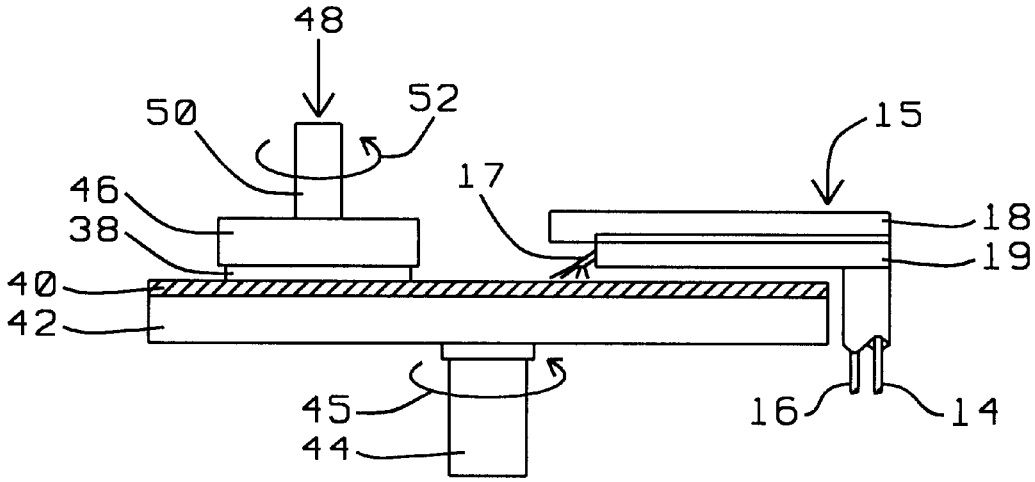
FIG. 1 – Prior Art
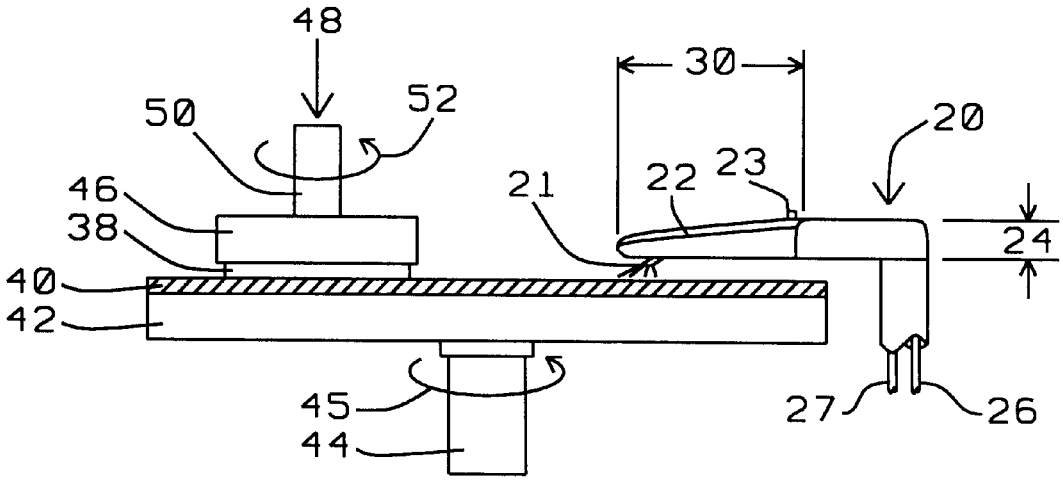
FIG. 2

SELF-CLEANING SLURRY ARM ON A CMP TOOL

BACKGROUND OF THE INVENTION (1) Technical Field

This invention is concerned with reducing scratches on substrates during chemical mechanical polishing, and more particularly to cleaning of splattered slurry from a slurry dispensing apparatus in order to prevent collection and drying of splatter from flaking off and landing on the polishing pad.

(2) Description of the Prior Art

The fabrication of integrated circuits on a semiconductor substrate involves a number of steps where patterns are transferred from photolithographic photomasks onto the substrate. Integrated circuits are typically formed on the substrates by the sequential deposition of conductive, semiconductive, or insulative layers. Selective etching of the layers assisted by photolithography forms specific structures and devices. Precise focusing for high-resolution photolithographic exposure yields well defined and highly integrated circuit structures.

During the forming of these well-defined integrated circuit structures, it has become increasingly important to construct line widths measuring in the submicron and nanomicron ranges. The photolithographic processing steps opens selected areas to be exposed on the substrate for subsequent processes such as oxidation, etching, metal deposition, and the like, providing continuing miniaturization of circuit structures. Each of the metal layers is typically separated from another metal layer by an insulation layer, such as an oxide layer. Therefore, there is a need to polish the substrate's constructed surface to provide a planar reference. Planarization effectively polishes away non-planar entities. To enhance the quality of an overlying layer, one without discontinuities of other blemishes, it is imperative to provide an underlying surface for the structured layer that is free of scratches and is ideally planar.

Conventionally, during the fabrication of integrated circuit structures, planarizing of the overlying structured layer is accomplished by CMP. The uniform removal of material from the patterned and non-patterned substrates is critical to substrate process yield. Generally, the substrate to be polished is mounted on a tooling head which holds the substrate using a combination of vacuum suction or other means to contact the rear side of the substrate and a retaining lip or ring around the edge of the substrate to keep the substrate centered on the tooling head. The front side of the substrate, the side to be polished, is then contacted with an abrasive material such as a polishing pad or abrasive strip. The polishing pad or strip may have free abrasive fluid sprayed on it, abrasive particles affixed to it, or may have abrasive particles sprinkled on it.

The ideal substrate polishing method used by most semiconductor foundries is CMP. This choice is based on numerous factors which include; control of relative velocity between a rotating substrate and a rotating polishing pad, the applied pressure between substrate and polishing pad, choosing the polishing pad roughness and elasticity, and a uniform dispersion of abrasive particles in a chemical solution (slurry). In summary, the CMP process should provide a constant cutting velocity over the entire substrate surface, sufficient pad elasticity, and a controlled supply of clump-free polishing slurry.

A CMP tool of the prior art, shown in simplified form in FIG. 1, illustrates a substrate 38 held by a tooling head 46 which rotates about the central axis of the substrate. A circular polishing pad 40 is rotated while in contact with the bottom surface of the rotating substrate being held by the tooling head. The rotating substrate contacts the larger rotating polishing pad in an area away from the center of the polishing pad 40. A slurry arm 15 positioned above the surface of the polishing pad dispenses a slurry 17, including an abrasive and at least one chemically-reactive agent, on the polishing pad 40 by way of a supply circuit 16, and carried to the interface between the polishing pad 40 and substrate 38. A problem with prior CMP systems is that splattering of slurry on the upper and side surfaces of the splash-board 18, of the slurry arm assembly 19, occurs because of the rotational interaction between the substrate and polishing pad during the polishing operation. The spatter lands on the slurry arm, thereafter, coating the upper and side surfaces of the splashboard 18. However, between polishing operations, or during extended periods following maintenance, the slurry splatter on the slurry arm will dry to form randomly dispersed globules that consist of dried abrasive particulates on the surfaces of the splashboard. These globules may fall off the slurry arm onto the polishing pad causing scratches on the polished surface of the substrate.

In view of the above problem, there is a need to improve the cleaning of the slurry arm assembly.

SUMMARY OF THE INVENTION

A major aspect of the invention is directed to cleaning an arm assembly that is used for supplying polishing slurry to a polishing pad in a chemical mechanical polishing tool. The invention is concerned with preventing scratches on surfaces of semiconductor substrates. During the polishing operation, an aggregate of dried slurry splatter dropping off the arm assembly to the rotating polishing pad, subsequently finding its way under a rotating substrate, and damaging its polished surface.

The apparatus has an arm assembly with a self-flushing profile that is positioned over a polishing pad and at least one nozzle placed under the arm assembly for dispensing slurry against the polishing pad. A second nozzle for dispensing a cleaning liquid is positioned on top of the arm assembly to flush away slurry splatter from the top and side surfaces of the arm assembly while assisting in cleaning the polishing pad. the top surface.

Applications of the invention may include using a cleaning liquid such as deionized water. It is therefore a primary object of the present invention to provide a slurry arm assembly with a self-flushing profile for flushing slurry splatter from the top and side surfaces of the slurry arm. The slurry arm has a top view profile similar to that of the prior art.

It is another object of the present invention to trim down the surface area of the arm assembly thereby reducing area for the splatter to adhere and shaping the arm assembly to eliminate all recessed regions and sharp comers.

It is still another object of the invention to provide a spray nozzle with a multiplicity of needle size orifices mounted to the top surface of the slurry arm to direct cleaning liquid with sufficient flow volume and velocity to cover and clean the top and side surfaces of the arm assembly.

It is yet another object of the present invention to provide a cleaning nozzle, that not only cleans the major surfaces of the arm assembly but is also used to supply deionized water for water polishing the substrate after planarizing.

The present invention is a self-cleaning apparatus for use in a chemical mechanical polishing tool. The apparatus includes a slurry-dispensing arm with a first end suspended over a polishing pad, and a second end for mounting to the chemical mechanical polishing tool. A slurry-dispensing nozzle is positioned under the first end for dispensing polishing slurry against the polishing pad. The first end has a compound slanted top surface, a front face and adjoining side surfaces. The compound slanted top surface forms a longitudinal peak slanting from center to both sides and from the back end to the front face. The top surface of the first end has a liquid distribution manifold that is mounted distally from the front face and has a plurality of nozzles frontally distributed to spray deionized water to wash away slurry splatter from surfaces of the first end of the slurry dispensing arm during the water polishing cycle.

These and further constructional and operational characteristics of the invention will be more evident from the detailed description given hereafter with reference to the figures of the accompanying drawings which illustrate preferred embodiments and alternatives by way of non-limiting examples.

DESCRIPTION OF THE DRAWINGS

FIG. 1 is a schematic front view of a CMP apparatus showing a slurry arm according to the prior art.

FIG. 2 is a schematic front view of a CMP apparatus with a slurry arm according to the invention.

DETAILED DESCRIPTION OF THE PREFERRED EMBODIMENT

Figure 3:
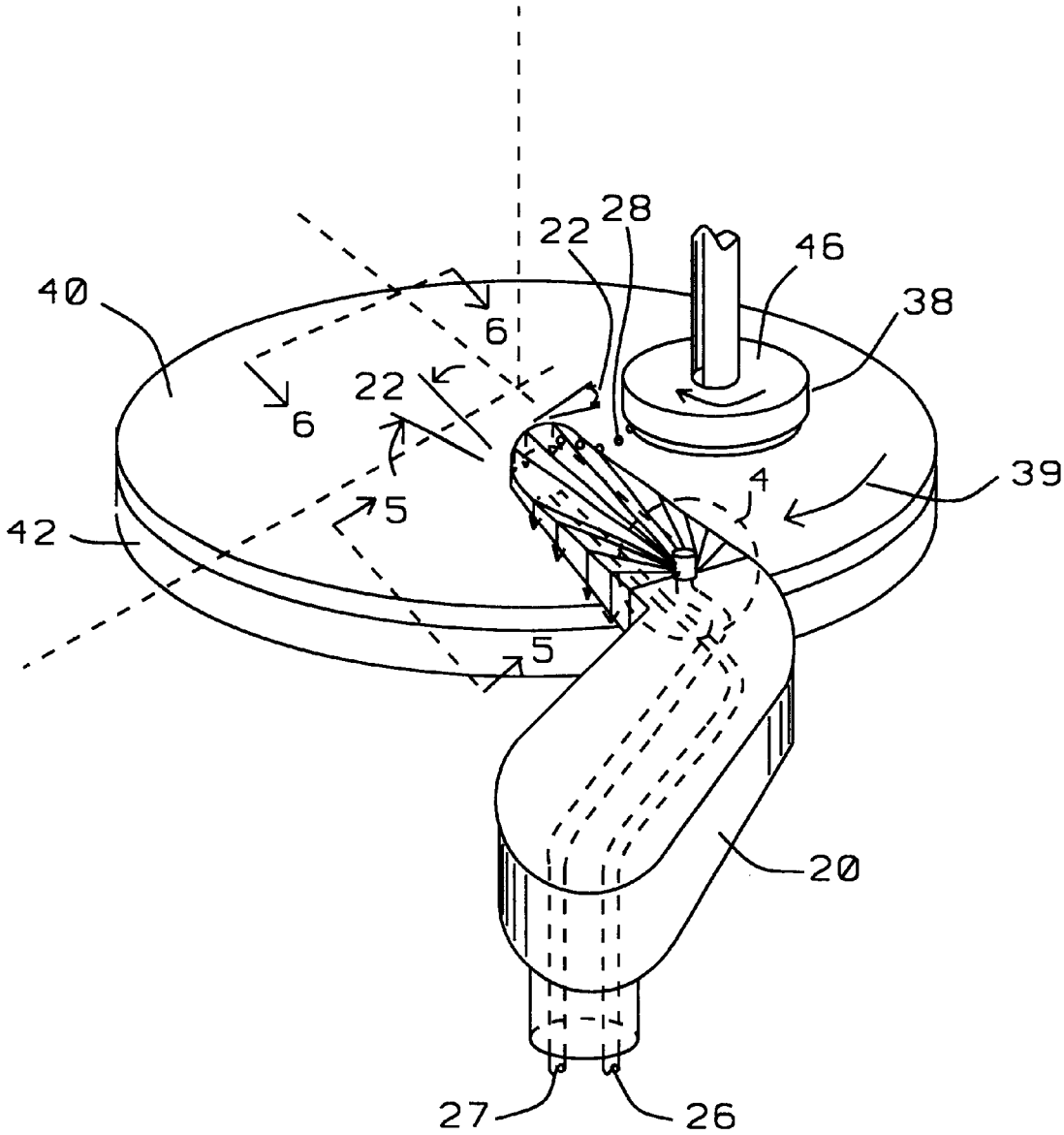
FIG. 3 is a top perspective view of the self-cleaning arm of the invention.

Referring to FIG. 1, showing a schematic rendering of a chemical mechanical polishing apparatus of the prior art, a brief review of the CMP apparatus and process follows.

The polishing pad 40, made of a porous material, is attached to the upper surface of a polishing platen 42. The polishing platen is horizontally supported by a platen-rotating shaft 44, and is rotationally driven 45 through the platen-rotating shaft during the polishing operation.

The polishing head assembly 46 having a lower surface opposed to the upper surface of the polishing pad 40. A recess forms a nesting surface and backing film (not shown) which centers and releasably holds the substrate 38 to be polished. The polishing head assembly is mounted to a shaft 50 and is rotated 52 relative to the rotating platen 42.

The CMP tool polishes the substrate 38, which is positioned face down and in firm contact, under pressure 48, with the rotating polishing pad 40. The substrate is also rotated either about an axis coincident with its own center or offset from its own center, but not coincident with the axis of rotation of the polishing pad 13. The abrasive polishing slurry is sprayed against the pad surface through a nozzle 17. As a result of the rotating contact and abrasive components in the slurry between the polishing pad 40 and the substrate 38, the substrate's surface becomes planarized after a designated time period. The rate of removal is closely proportional to the pressure 48 applied to the substrate 38. Furthermore, the rate of removal depends upon the topography of the top layer of substrate 38, as higher features (extending further from the substrate surface) are removed faster than lower features. Several techniques are presently used to assist in oxide removal, for example, maintaining a fresh supply of polishing slurry on the polishing surface of the polishing pad and, maintaining a uniform polishing texture on the surface of the polishing pad.

A requirement for keeping the planarization rate constant is to properly clean and maintain the surface state of the polishing pad 40. Without such maintenance, or in the alternative, without repeatedly changing the polishing pad 40, the oxide removal rate would continue to fall as more substrates are polished, since the surface roughness tends to decrease and such roughness determines, in large part, the overall abrasiveness of the polishing pad 40 and slurry 17.

Referring now more specifically to FIGS. 1 there is shown a schematic of a CMP tool, of the prior art, illustrating the location of a rinse arm assembly 15 relative to a polishing pad 40 and substrate holder 46 used for the planarization of layered surfaces contained on a semiconductor substrate 38. The circular polishing pad 40 is rotated while in contact with the layered surface of the semiconductor substrate 38, which is held facing the pad. The substrate holder 46 rotates the substrate. The rotating substrate contacts the larger rotating polishing pad 40 in an area away from the center of the pad.

The rinse arm assembly 15 is positioned above the surface of the polishing pad 40. The arm assembly 15, has a nozzle 17 affixed to its front end for spraying a liquid slurry downward against the polishing pad 40 during the polishing cycle. The liquid slurry is supplied by way of a pressurized first liquid supply circuit 16. An overhanging splashboard 18 is mounted over the top of the arm to protect against slurry splatter, rebounding off the pad, from landing on the top and side surfaces of the arm assembly 15. A second pressurized liquid circuit 14 supplies water for periodically cleaning the polishing pad 40.

The problem with conventional CMP systems is that splattering of slurry on the upper and side surfaces of the splash-board 18, of the slurry arm assembly 19, occurs because of the rotational interaction between the substrate and polishing pad during the polishing operation. The spatter lands on the splashboard eventually coating and accumulating on its upper and side surfaces. As a consequence, after an idle period, as for example, after maintenance, or after several polishing operations, the slurry splatter dries on the splashboard surfaces forming randomly dispersed globules that consist of abrasive aggregates on the surfaces of the splashboard. These aggregate globules fall off and land on the polishing pad, soon after, producing scratches on the surface of the substrate being polished.

There will now be described in detail with reference to the drawings some preferred embodiments of the present invention applied to the slurry/rinse arm assembly used with a chemical mechanical polishing tool for the planarization of a semiconductor substrate. In the following description of the preferred embodiments, the same reference numerals as those in the prior art denote similar parts for convenience of illustration. The descriptive and functional operation of the similar parts will not be repeated.

Comparing FIG. 1 to FIG. 2 showing a visual difference between the size (surface area) and the shape of each of the rinse arm assemblies. In FIG. 2, a preferred embodiment of the invention, illustrates a schematic side view a CMP tool with a rinse arm assembly 20 including apparatus and process improvements described in the following paragraphs.

Also referring to FIG. 3 that shows a perspective top view of the rinse arm assembly 20 having an angular shape. The arm 20 has a top surface, side surfaces and a bottom surface. The rinse arm has a first end 30 overhanging a radial segment of the polishing pad 40. The first end includes a sloped top surface and adjoining side surfaces. The second end of the rinse arm 20 is the supporting structure mounted to a stationary member (not shown) on the CMP tool.

Figure 4:
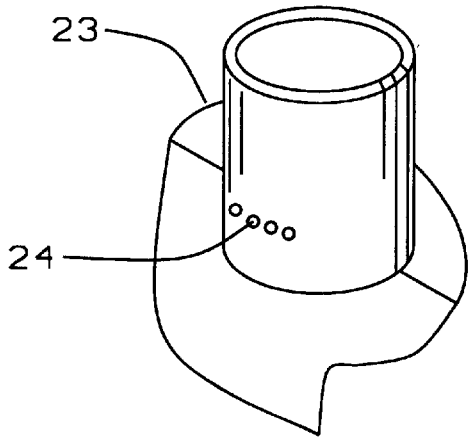
FIG. 4 is an enlarged fragmented view of a self cleaning spray nozzle of the invention.
Figure 5:
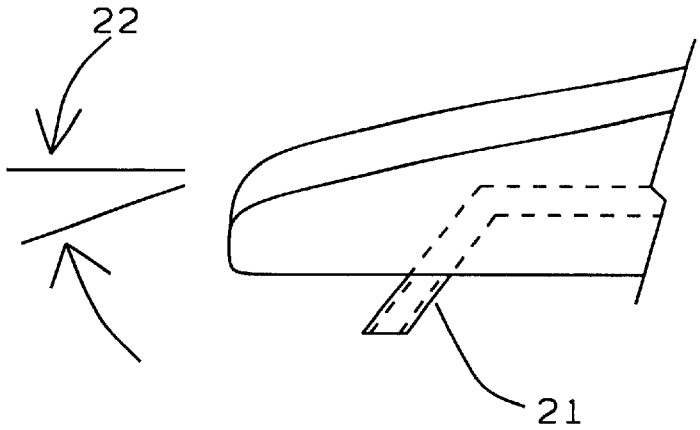
FIG. 5 is a fragmented side view of the slurry-dispensing nozzle of the invention.
Figure 6:
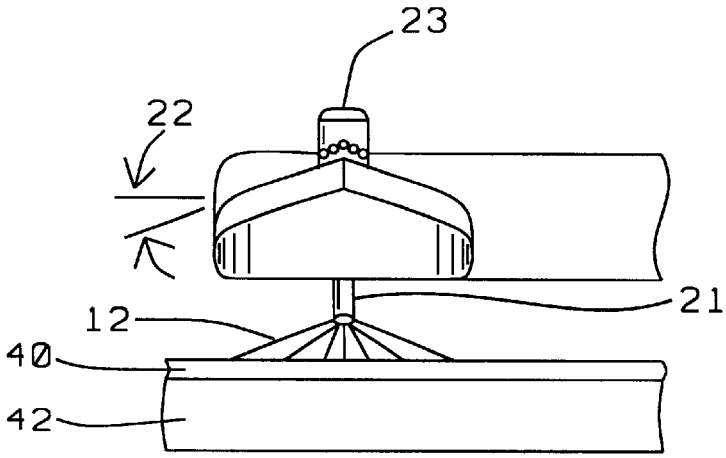
FIG. 6 is a fragmented front view of the slurry and the self cleaning spray nozzle of the invention.

FIGS. 4, 5 and 6 are various illustrations clarifying specific views of arm 20.

The top surface of the first end 30 includes a liquid distribution manifold 23 having a plurality of liquid spray nozzles 24 for spraying a cleaning liquid 27. FIG. 4 illustrates an enlarged view of the manifold 23. The plurality of nozzles 24 are positioned to direct a fanned spray of cleaning liquid to flow from the area proximal the manifold 23 to flow towards the front end and down the sides of the first end of the rinse arm 20. The liquid distribution manifold 23 is positioned at the top end of the front half and is remotely supplied from a controllable pressurized liquid source (not shown) to the inlet circuit 27. Directional flow 25 shown emerging from the nozzles, indicate the direction of the flushing pattern of the cleaning liquid. The purpose of the nozzle placement is to flush the top and side surfaces, of the first end 30 of the rinse arm with the cleaning liquid, preferably deionized water (D.I. water) such that it runs-off onto the polishing pad 40. To further enhance the run-off, a compound slant angle 22 is formed longitudinally on the top surface on each side of center, peaking at the back end and slanting downward towards each side and towards the front end of the first end 30. The compound slant angle 22 is best illustrated in FIG. 5 and FIG. 6. The slant angle surfaces start behind the liquid distribution manifold 26 to promote flushing of the top and side surfaces, of the rinse arm 20, directly above the polishing pad and to limit its run-off only onto the polishing pad.

Referring again to FIG. 2, best showing a side view of the bottom of the first end 30 of the rinse arm 20 having a slurry outlet nozzle 21 for spraying slurry against polishing pad 40. The slurry is supplied under pressure through circuit 26 shown under the second end of the rinse arm. FIGS. 3, 5, and 6 show the slurry outlet nozzle 21 protruding at an angle and protected under the first end of the rinse arm for spraying slurry against polishing pad 40.

The frequency of flushing would be determined by process control within a normal CMP process flow sequence. The normal CMP process flow sequence is as follows:

A substrate is loaded on the polishing head assembly 46. The CMP tool polishes the substrate 38, which is positioned face down and in firm contact, under pressure 48, with the rotating polishing pad 40. The abrasive polishing slurry is sprayed against the pad surface through nozzle 26. As a result of the rotating contact and abrasive components in the slurry between the polishing pad 40 and the substrate 38, the substrate's surface becomes planarized after an allotted time period. Slurry dispensing is then stopped, and D.I. water is sprayed against the polishing pad to water polish the substrate.

In the process of the invention, the supply of D.I. water for water polishing the substrate would be supplied from the plurality of nozzles 24 of the liquid distribution manifold 23. Moreover, the cleaning of the slurry splatter would be flushed from the surfaces of the slurry arm surfaces during the water polishing cycle.

This process, therefore, corresponds with the standard CMP operation without introducing additional cycle time. Furthermore, down-time for preventive maintenance, necessary for cleaning the rinse arm surfaces, would be substantially reduced or eliminated since the slurry splatter would not have time to accumulate nor to dry, accordingly, would eliminate the substrate scratches attributed to the dried abrasive aggregates falling on the polishing pad and then transported under the substrate.

While the invention has been particularly shown and described with reference to the preferred embodiments thereof, it will be understood by those skilled in the art that various changes in form and details may be made without departing from the spirit and scope of the invention.

What is claimed is:

1. A self-cleaning apparatus for use in a chemical mechanical polishing tool, comprising:

a slurry dispensing arm having a first end suspended over a polishing pad, and a second end for mounting to the chemical mechanical polishing tool;

at least one slurry nozzle positioned under said first end of said slurry dispensing arm, said slurry nozzle distributes a slurry against said polishing pad for polishing substrates;

said first end including a top surface, a front face and adjoining side surfaces;

said top surface of said first end is made with a compound slanted longitudinal peak slanting downward from its highest elevation towards each side and from back to front;

said top surface of said first end having a liquid distribution manifold distally mounted from said front face;

said liquid distribution manifold having a plurality of nozzles for directing a cleaning liquid to wash said first end surfaces, from said longitudinal peak, down each side, front face onto said polishing pad.

2. The apparatus of claim 1, wherein said slurry nozzle that is positioned under said first end of said slurry dispensing arm is supplied with slurry from a pressurized supply circuit.

3. The apparatus of claim 1, wherein said plurality of nozzles are directed to spray a cleaning liquid, after slurry polishing, said cleaning liquid washes away splattered slurry thrown against said first end surfaces during the polishing of said substrates.

4. The apparatus of claim 3, wherein said cleaning liquid is deionized water.

5. The apparatus of claim 1, wherein the runoff of deionized water onto said polishing pad is also used as the water source during a water polishing cycle required after each slurry polishing cycle.

6. The apparatus of claim 1, wherein placing said liquid distribution manifold on top of said first end to provide self cleaning of slurry splatter after each slurry polish cycle prevents aggregates of dried slurry from forming thereby reducing scratches on polished substrates caused by dried slurry falling from said slurry dispensing arm to said polishing pad.

7. A method for self-cleaning a slurry dispensing arm for use in a chemical mechanical polishing tool, said method comprising the steps of:

providing a slurry dispensing arm having a first end suspended over a polishing pad, and a second end for mounting to the chemical mechanical polishing tool, and at least one slurry nozzle positioned under said first end of said slurry dispensing arm, said slurry nozzle distributes a slurry against said polishing pad for polishing substrates;

said first end including a top surface, a front face and adjoining side surfaces;

said top surface of said first end is made with a compound slanted longitudinal peak slanting downward from its highest elevation towards each side and from back to front;

said top surface of said first end having a liquid distribution manifold distally mounted from said front face;

said liquid distribution manifold having a plurality of nozzles for directing a cleaning liquid to wash said first end surfaces, from said longitudinal peak, down each side, front face onto said polishing pad.

8. The method of claim 7, wherein said slurry nozzle that is positioned under said first end of said slurry dispensing arm is supplied with slurry from a pressurized supply circuit.

9. The method of claim 7 wherein said plurality of nozzles are directed to spray a cleaning liquid, after slurry polishing, said cleaning liquid washes away splattered slurry thrown against said first end surfaces during the polishing of said substrates.

10. The method of claim 9, wherein said cleaning liquid is deionized water.

11. The method of claim 7, wherein the runoff of deionized water onto said polishing pad is also used as the water source during a water polishing cycle performed after each slurry polishing cycle.

12. The method of claim 7, wherein placing said liquid distribution manifold on top of said first end to provide self cleaning of slurry splatter after each slurry polish cycle prevents aggregates of dried slurry from forming thereby reducing scratches on polished substrates caused by dried slurry falling from said slurry dispensing arm to said polishing pad.

13. A method for self-cleaning a slurry dispensing arm for use in a chemical mechanical polishing tool, said method comprising the steps of:

providing a chemical mechanical polishing tool;

providing a substrate to be polished;

providing a slurry dispensing arm having a first end suspended over a polishing pad, and a second end for mounting to the chemical mechanical polishing tool, and at least one slurry nozzle positioned under said first end of said slurry dispensing arm, said slurry nozzle distributes a slurry against said polishing pad for polishing substrates;

said first end including a top surface, a front face and adjoining side surfaces;

said top surface of said first end is made with a compound slanted longitudinal peak slanting downward from its highest elevation towards each side and from back to front;

said top surface of said first end having a liquid distribution manifold distally mounted from said front face;

said liquid distribution manifold having a plurality of nozzles for directing a cleaning liquid to wash said first end surfaces, from said longitudinal peak, down each side, front face onto said polishing pad.

14. A method of claim 13, further comprising;

loading said substrate to a polishing head assembly;

rotate said polishing pad and dispense an abrasive slurry against said polishing pad;

lower and rotate said polishing head holding said wafer against said rotating polishing pad;

at completion of polishing of substrate, stop dispensing said abrasive slurry;

rinse said first end of said slurry arm and begin water polish of said substrate;

at completion of water polish, remove polished substrate.

15. The method of claim 13, wherein said slurry nozzle that is positioned under said first end of said slurry dispensing arm is supplied with slurry from a pressurized supply circuit.

16. The method of claim 13 wherein said plurality of nozzles are directed to spray a cleaning liquid, after slurry polishing, said cleaning liquid washes away splattered slurry thrown against said first end surfaces during the polishing of said substrates.

17. The method of claim 16, wherein said cleaning liquid is deionized water.

18. The method of claim 13, wherein the runoff of deionized water onto said polishing pad is also used as the water source during a water polishing cycle performed after each slurry polishing cycle.

19. The method of claim 13, wherein placing said liquid distribution manifold on top of said first end to provide self cleaning of slurry splatter after each slurry polish cycle prevents aggregates of dried slurry from forming thereby reducing scratches on polished substrates caused by dried slurry falling from said slurry dispensing arm to said polishing pad.

* * * * *